United States Patent [19]

Hillsberry

[11] Patent Number: 4,539,723

[45] Date of Patent: Sep. 10, 1985

[54] AUXILIARY MATTRESS CORNERS

[76] Inventor: Jerl D. Hillsberry, 5219 Galahad, San Antonio, Tex. 78218

[21] Appl. No.: 615,107

[22] Filed: May 29, 1984

[51] Int. Cl.[3] ..... A47C 21/02

[52] U.S. Cl. ..... 5/504; 5/508; 24/72.5

[58] Field of Search ..... 5/498, 496, 411, 504, 5/482, 507, 451, 508; 24/72.5

[56] References Cited

U.S. PATENT DOCUMENTS

| | | | |
|---|---|---|---|
| 267,498 | 11/1882 | Cox | 5/498 |
| 2,154,557 | 4/1939 | Bechik | 5/411 |
| 2,653,363 | 9/1953 | Lievsay, Jr. | 24/72.5 |
| 4,017,919 | 4/1977 | Hemmeter | 5/411 |
| 4,199,831 | 4/1980 | Muller | 5/411 |

*Primary Examiner*—Alexander Grosz

*Attorney, Agent, or Firm*—Norvell & Associates

[57] ABSTRACT

This invention relates to an accessory article for those liquid filled bed mattresses that are commonly marketed as "Waterbeds" and/or "Water Beds". Installation to said type beds provides a rigid "auxiliary mattress corner" to which mattress cover and fitted sheet may be attached to remain securely and snugly fitted to said mattresses in normal daily usage. This invention may also be attached to conventionally constructed mattress, that is, fiber/spring and/or polymerics for the same purpose and result as with said type liquid filled mattresses.

3 Claims, 8 Drawing Figures

AUXILIARY MATTRESS CORNERS

BACKGROUND OF THE INVENTION

Liquid filled or "Waterbed" mattresses have been in the market place for a number of years. Said type mattresses do have a serious inherent deficiency, namely, that of being very soft and sponge like at their corners. Stated deficiency causes great difficulty in the attaching of mattress covers and fitted sheets and in the retention of said coverings in a secure and snug manner in normal usage of said type mattresses. Re-attachment and/or tightening of coverings is required almost daily to cause a great amount of inconvenience and aggravation to the users of said type beds.

The inventor was not able to locate any type device being marketed for the correction of stated deficiency. The inventor did design and construct prototypes for personal use. These prototypes were installed on both said type "water mattress" and conventional type mattress. Prototypes remain in place to achieve stated purposes and results after extensive "in home" use.

SUMMARY

This invention relates to a structurally shaped unit which when inserted between the corners of the "Waterbed" mattress and bedframe does itself become a firm "corner post" to which mattress covers and fitted sheets can be easily attached and retained to said mattress in a secure and snugly fitted manner.

The normal installation requires one unit at each bed corner. Units are held securely in place by the weight of the "Waterbed" mattress and abuttment to the bedframe. Units can be easily installed or removed in a few minutes by most persons. Units require no physical affixment, that is; glueing, taping, nailing etc. Units contain no metallic fasteners or sharp edges or corners which could cause damage to water mattress or sheets or covers. Installed units are completely hidden from view and are totally unobtrusive to the users of said type beds.

This invention may also be applied for the same mentioned purposes, to bed mattresses of conventional construction, that is fiber/spring and/or polymerics.

DESCRIPTION OF THE PREFERRED EMBODIMENT

Figure 1:
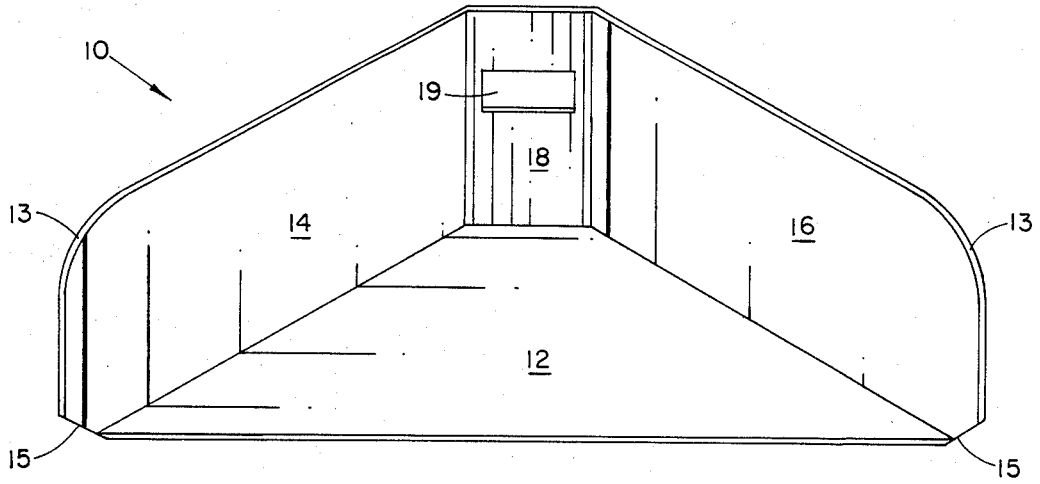
FIG. 1 is a perspective view of the preferred embodiment as designed for use with "Waterbeds".

For the purposes of promoting an understanding of the invention reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates. Referring to FIG. 1, 10 illustrated the preferred embodiment as designed and constructed for use with those liquid filled mattresses which are commonly marketed as "Water Beds". Said unit shows a structure having essentially four connected sides or planes depicted by 12, 14, 16 and 18. Sides or planes may be of solid, latticed or framular construction or combinations thereof.

Typical installation of said units to said type beds requiring four, one at each mattress corner. Said units are installed by lifting mattress corners and inserting between mattress and "Water Bed" frame. Mattress is then returned to original position to rest directly upon the horizontal 12 and abutt to the vertical 14, 16, and 18. Mattress corner being abutt to 18 which is adjacent to bedframe corner. The units 10 thus become rigid "auxiliary mattress corners" to which fitted sheets and mattress covers may be attached to be retained in a secure and snugly fitted manner in normal daily usage. Said units are retained securely in place by the force exerted by the weight of said mattress, pressing said units to normally solid bed frame walls. Said pressure is further increased when persons are resting on said mattress.

The oblique angle of 18, in respect to 14 and 16, affords a "hand access space" between 18 and the usually right angled bed frame corner. Said "hand access space" in conjunction with "hand hold space" 19 and edges 15 and rounded edges 13 are for purpose to allow ease of lifting said units to rest on edges 15 in an atilt position. Said atilt positions is for purpose of facilitating attachment and/or removal of covering components. Said coverings are attached to said units in the same manner as to conventional type mattresses. Said units are returned to the installed position by slight downward hand pressure exerted at top edge of 18.

Figure 2:
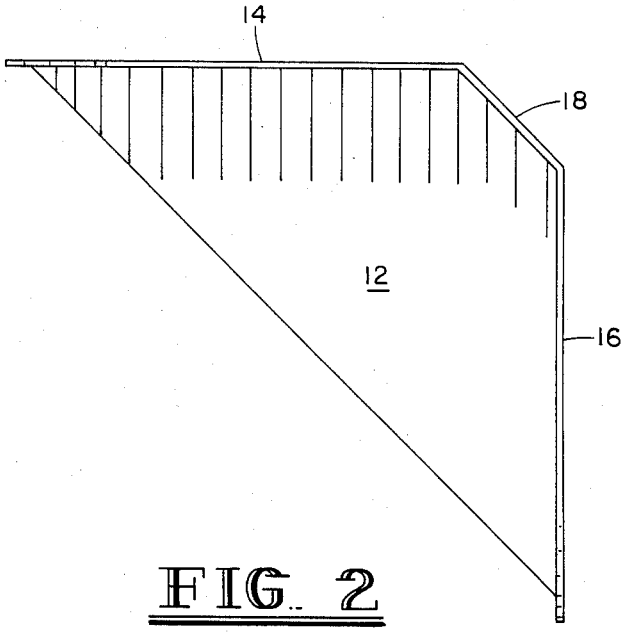
FIG. 2 is a top view of FIG. 1.
Figure 3:
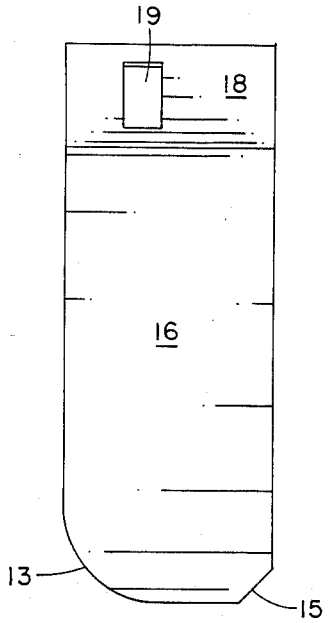
FIG. 3 is a partial side elevation view of FIG. 1.
Figure 4:
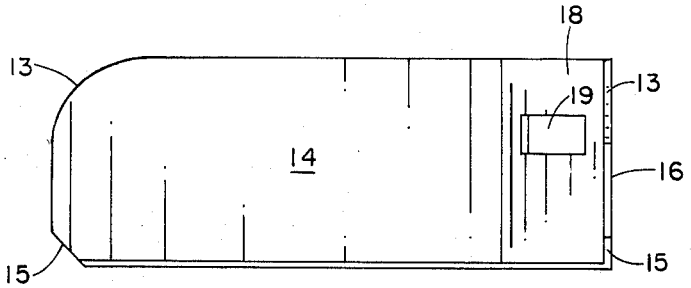
FIG. 4 is a side elevation view of FIG. 1.
Figure 5:
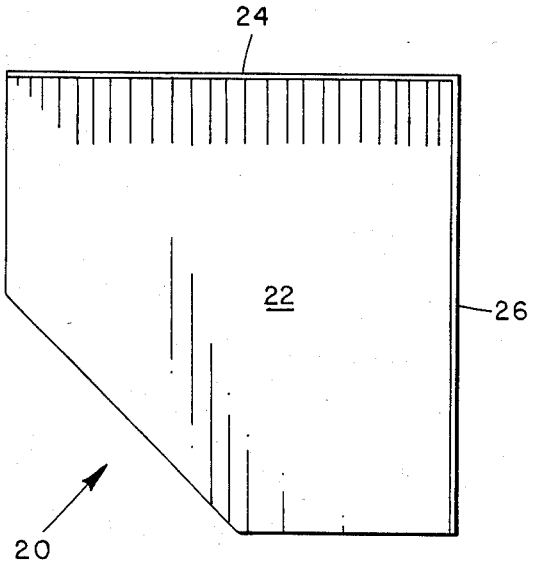
FIGS. 5, 6, 7 and 8 show top views of alternate designs of the embodiment.
Figure 6:
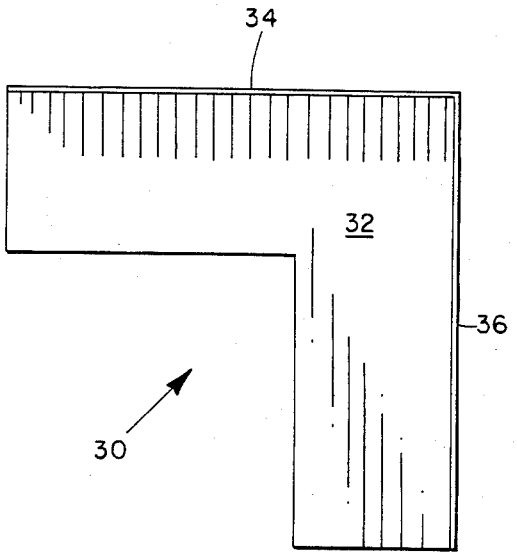
Figure 7:
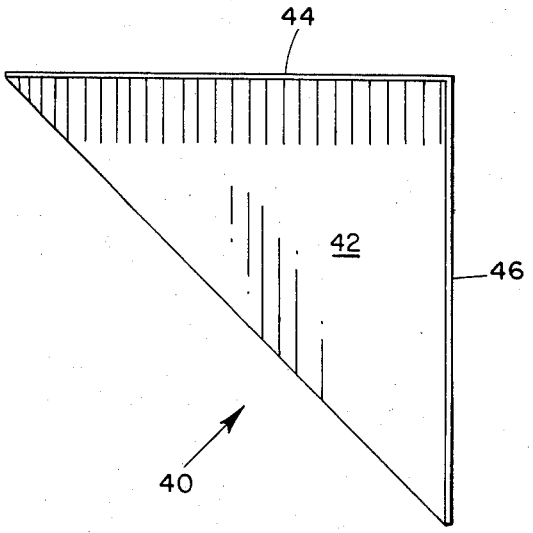
Figure 8:
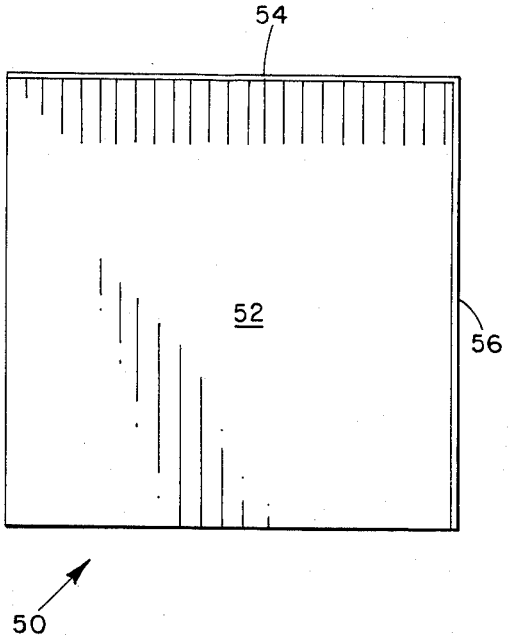

FIGS. 5, 6, 7 and 8 illustrate top views of alternative embodiments of the invention. Sides or planes 22, 32, 42 and 52 of said Figures respectively being essentially equivalent to 12 of FIG. 2 of the preferred embodiment. Sides or planes 24 and 26 and 34 and 36 and 44 and 46 and 54 and 56 being essentially equivalent to 14 and 16 of FIG. 2 of the preferred embodiment.

The preferred embodiment of FIG. 1 and the alternate embodiments of FIGS. 5, 6, 7 and 8 are all applicable to said "Water Beds" and beds of conventional fiber/spring and/or polymeric form constructions.

While the invention has been illustrated and described in detail in the drawing and foregoing description, the same is to be considered as illustrative and not restrictive in character, it being understood that the preferred embodiment and some alternative embodiments have been shown and described and that all changes and modifications that come within the spirit of the invention are desired to be protected.

I claim:

1. A method for attaching and securing fitted sheets or mattress covers to liquid filled bed mattresses or conventional bed mattresses accomplished by:

a. Placement of a rigid corner forming device beneath and in abutment with each of the side walls of said mattress corners;

b. Securing the corner portions of said fitted sheets or covers respectively around said corner forming devices.

2. A rigid corner forming device for a corner of a soft deformable mattress on a bed frame comprising:

a rigid horizontal wall insertable between the mattress corner and the bed frame;

the outer perimeter portions of said bottom wall conforming generally to the overlying mattress corner;

a rigid vertical wall formed of sheet material and rigidly attached at its bottom end to said outer perimeter portion of said bottom wall, thereby defining a rigid corner for engagement by the corner portion of a fitted mattress cover thereto;

said vertical wall comprising two wall portions disposed in generally perpendicular relationship to each other and to said bottom horizontal wall;

an intermediate wall portion rigidly secured in an angular relationship between the adjacent edges of said two wall portions, and an opening formed in said intermediate wall portion to facilitate the handling of the device.

3. A rigid corner forming device for a corner of a soft deformable mattress on a bed frame comprising;

a rigid horizontal wall insertable between the mattress corner and the bed frame;

the outer perimeter portions of said bottom wall conforming generally to the overlying mattress corner;

a rigid vertical wall formed of sheet material and rigidly attached at its bottom end to said outer perimeter portion of said bottom wall, thereby defining a rigid corner for engagement by the corner portion of a fitted mattress cover thereto;

said vertical wall comprising two vertical wall portions disposed in generally perpendicular relationship to each other and to said bottom horizontal wall; wherein the bottom portions of the non-adjacent edges of said two vertical wall portions are recessed to facilitate upward tilting movement of said corner device relative to the bed frame.

* * * * *